US008393017B2

(12) United States Patent
Sheren

(10) Patent No.: US 8,393,017 B2
(45) Date of Patent: Mar. 12, 2013

(54) APPARATUS TO BE WORN ON AN INDIVIDUAL'S CHEST BELOW A FULL FACE HELMET TO LIMIT THE OCCURRENCE OF CERVICAL SPINAL CORD INJURIES IN THE EVENT OF A CRASH

(75) Inventor: Brady Sheren, Surrey (CA)

(73) Assignee: Brady Sheren Designs Inc., Surrey, British Columbia (CA)

( * ) Notice: Subject to any disclaimer, the term of this patent is extended or adjusted under 35 U.S.C. 154(b) by 111 days.

(21) Appl. No.: 13/136,721

(22) Filed: Aug. 9, 2011

(65) Prior Publication Data

US 2013/0036538 A1 Feb. 14, 2013

(51) Int. Cl.

| | |
|---|---|
| ***A41D 13/05*** | (2006.01) |
| ***A42B 3/04*** | (2006.01) |
| *A61F 5/055* | (2006.01) |
| *A41D 13/00* | (2006.01) |

(52) U.S. Cl. ..... 2/468; 2/456; 2/459; 2/461; 2/467; 2/425

(58) Field of Classification Search ..... 602/18, 602/17, 12, 5, 1; 2/425, 2, 410, 411, 415, 2/416, 418, 421, 422, 455, 459, 461, 468; 280/290; 244/122 AG See application file for complete search history.

(56) References Cited

U.S. PATENT DOCUMENTS

| | | | | |
|---|---|---|---|---|
| 3,134,106 | A * | 5/1964 | Shaffer et al. | 2/462 |
| 3,591,863 | A * | 7/1971 | Rickard | 2/415 |
| 3,873,996 | A * | 4/1975 | Varteressian | 2/421 |
| 3,968,994 | A * | 7/1976 | Chika | 297/486 |
| 4,638,510 | A * | 1/1987 | Hubbard | 2/6.1 |
| 4,821,339 | A * | 4/1989 | Fair | 2/462 |
| 4,923,147 | A * | 5/1990 | Adams et al. | 244/122 AG |
| 5,123,408 | A * | 6/1992 | Gaines | 602/17 |
| 5,261,125 | A * | 11/1993 | Cartwright et al. | 2/421 |
| 5,272,770 | A * | 12/1993 | Allen et al. | 2/421 |
| 5,566,399 | A * | 10/1996 | Cartwright et al. | 2/421 |
| 6,006,368 | A * | 12/1999 | Phillips | 2/468 |
| 6,253,389 | B1 * | 7/2001 | Scaglione | 2/456 |
| 6,308,345 | B1 * | 10/2001 | Williams, Jr. | 2/468 |
| 6,447,468 | B1 * | 9/2002 | Hankins et al. | 602/18 |
| 6,591,430 | B1 * | 7/2003 | Sledge | 2/468 |
| 7,017,194 | B2 * | 3/2006 | Schroth | 2/410 |
| 7,155,747 | B2 * | 1/2007 | Baker | 2/422 |
| 7,255,679 | B2 * | 8/2007 | Kania et al. | 602/4 |
| 7,430,767 | B2 * | 10/2008 | Nagely | 2/425 |
| 7,846,117 | B2 * | 12/2010 | Leatt et al. | 602/18 |
| 7,979,922 | B2 * | 7/2011 | Ronco | 2/459 |
| 8,057,415 | B2 * | 11/2011 | Hipp et al. | 602/18 |
| 8,251,934 | B2 * | 8/2012 | Bonutti | 602/18 |
| 8,276,217 | B1 * | 10/2012 | Hamilton | 2/467 |
| 2004/0255368 | A1 | 12/2004 | Baker | |
| 2006/0217648 | A1 * | 9/2006 | Rogachevsky | 602/20 |
| 2008/0177209 | A1 * | 7/2008 | Leatt et al. | 602/18 |
| 2010/0263112 | A1 * | 10/2010 | Mazzarolo et al. | 2/468 |
| 2010/0281606 | A1 * | 11/2010 | Kordecki | 2/462 |
| 2011/0041240 | A1 * | 2/2011 | Mazzarolo | 2/468 |

FOREIGN PATENT DOCUMENTS

| | | | |
|---|---|---|---|
| RU | 2126666 | C1 | 2/1999 |

* cited by examiner

*Primary Examiner* — Bobby Muromoto, Jr.
(74) *Attorney, Agent, or Firm* — Thomas I. Rozsa

(57) ABSTRACT

An apparatus to be worn on an individual's shoulders, chest and back below a full face helmet to limit the occurrence of cervical spinal cord injuries in the event of a crash.

19 Claims, 11 Drawing Sheets

APPARATUS TO BE WORN ON AN INDIVIDUAL'S CHEST BELOW A FULL FACE HELMET TO LIMIT THE OCCURRENCE OF CERVICAL SPINAL CORD INJURIES IN THE EVENT OF A CRASH

BACKGROUND OF THE INVENTION

1. Field of the Invention

The invention is a support system designed to work in conjunction with a full face helmet to limit the chances of cervical spinal cord injuries suffered by way of motor sports, and/or bicycle sport crashes/falls/accidents.

2. Description of the Prior Art

The following 16 patents and published patent applications are relevant to the field of the present invention.

1. U.S. Pat. No. 3,134,106 issued to Archie Shaffer et al. on May 26, 1964 for "Protective Football Apparatus" (hereafter the "Shaffer Patent");

2. U.S. Pat. No. 3,873,996 issued to Levon Antoine Varteressian on Apr. 1, 1975 for "Articulated Head and Neck Protection Apparatus" (hereafter the "Varteressian Patent");

3. U.S. Pat. No. 4,638,510 issued to Robert P. Hubbard on Jan. 27, 1987 for "Neck Protection Device With Occupant Of A High Performance Vehicle" (hereafter the "Hubbard Patent");

4. U.S. Pat. No. 4,821,339 issued to Jeffrey D. Fair on Apr. 18, 1989 for "Protective Vest Having A Cervical Collar" (hereafter the "Fair Patent");

5. U.S. Pat. No. 5,123,408 issued to Leonard F. Gaines on Jun. 23, 1992 for "Sports Helmet Braced For Protection Of The Cervical Spine" (hereafter the "Gaines Patent");

6. U.S. Pat. No. 5,272,770 issued to Richard K. Allen et al. on Dec. 28, 1993 for "Head Restraining System" (hereafter the "Allen Patent");

7. U.S. Pat. No. 6,006,368 issued to Richard L. Phillips on Dec. 28, 1999 for "Combination Helmet And Shoulder Pad For Minimizing Cervical Injuries" (hereafter the "Phillips Patent");

8. U.S. Pat. No. 6,591,430 issued to Wilson Harris Sledge on Jul. 15, 2003 for "Head And Neck Support Apparatus" (hereafter the "Sledge Patent");

9. United States Published Patent Application No. 2004/0255368 to Greg S. Baker on Dec. 23, 2004 for "Head Stabilizing System" (hereafter the "Baker Published Patent Application);

10. U.S. Pat. No. 7,017,194 issued to Carl-Jurgen Schroth on Mar. 28, 2006 for "Restraint System For Restraining A Person In A Vehicle Of Transportation" (hereafter the "Schroth Patent");

11. U.S. Pat. No. 7,155,747 issued to Greg S. Baker on Jan. 2, 2007 for "Head Stabilizing System" (hereafter the "Baker Patent");

12. U.S. Pat. No. 7,430,767 issued to Scott W. Nagely on Oct. 7, 2008 for "Protective Helmet With Motion Restrictor" (hereafter the "Nagely Patent");

13. United States Published Patent Application No. 2010/0263112 to Giovanni Mazzarolo et al. on Oct. 21, 2010 for "Neck Protective Collar With Safety Breakable Structure" (hereafter the "'0263112 Mazzarolo Published Patent Application");

14. United States Published Patent Application No. 2010/0281606 to Michael E. Kordecki on Nov. 11, 2010 for "Protective Shoulder Pads With Release Mechanism" (hereafter the "Kordecki Published Patent Application");

15. United States Published Patent Application No. 2011/0041240 to Giovanni Mazzarolo on Feb. 24, 2011 for "Protective Device For The Neck" (hereafter the "'0041240 Mazzarolo Published Patent Application");

16. Russian Patent No. RU2126666C1 issued to Arturovich Jukhan Gross on Feb. 27, 1999 for "Multipurpose Protective Girdle" (hereafter the "Gross Patent").

The Shaffer Patent which issued in 1964 discloses a protective football apparatus. It essentially has a front chest protector which can be locked in place.

The Varteressian Patent which issued in 1975 has a member which is affixed to the back of a helmet and can be rotated to various orientations to provide different degrees of protection. Specifically, the patent discloses:

> "An articulated head and neck protector apparatus for limiting extreme movements of the head and neck of a person wearing a helmet and a jacket. A ball is rotatably mounted in a socket which is supported by the jacket. The socket defines a pair of transverse slots. A track is provided on the back of the helmet for slidably supporting a tracker. One end of a control arm is attached to the tracker and the other end of the arm is attached through one of the slots to the ball. A pin extends from the ball through the other slot. The arm and the pin limit the turning and twisting of the head and neck to within safe limits."

The Hubbard Patent is a neck protection device which effectively consists of a very stiff yolk which then extends to a stiff collar connected to the helmet. Specifically, the patent discloses:

> "A neck protection device (10) for a driver (10) or other occupant of a high performance vehicle adapted to reduce motions or loading in the neck and upper torso is described. The device includes in combination a stiff yoke (12) with a high collar (11) extending up from the yoke and a set of tethers (15, 15*a* and 15*b*) for attachment to the lateral and rear portions of a helmet (16) and collar. The high collar extends upward to adjacent the center of gravity of the head and helmet which is at about eye level of the occupant. The tethers on the collar allow needed head movements and yet reduce the potential for fatigue and crash injury by carrying forces which would otherwise be transmitted through the neck and by reducing extreme motions of the neck."

Claim 1 of the patent reads as follows:

> "A neck protection device for a shoulder and lap belted driver or other occupant of a high performance vehicle having forward and lateral fields of view with a helmet on the head of the occupant and with horizontal level center of gravity of the head and helmet combined at about eye level of the occupant which comprises:
>
> (a) a stiff restraining means including lateral, front and rear portions relative to the occupant which is contoured to fit the rib cage and shoulders and around the neck of the occupant;
>
> (b) a stiff high collar mounted on the restraining means, having lateral, front and rear portions relative to the occupant, which extends upward to adjacent the center of gravity of the head and helmet combined and adjacent the neck of the occupant around the lateral and rear portions of the restraining means and which is open at the front portion of the restraining means and allows movement of the helmeted head to provide the forward and lateral fields of view; and
>
> (c) first fastening means mounted around the collar adjacent the center of gravity of the helmeted head for attaching a plurality of tethers between the lateral and rear portions of the collar and the helmet, wherein the tethers provide a restraint which is in a substantially horizontal plane between the helmet and the collar and wherein in normal vehicle operation or in a crash the collar transmits forces to the restraining means from the tethers thereby reducing the forces being transmitted through the neck which cause fatigue and injury in vehicle operation or in a crash."

The Fair Patent is a protective vest but effectively is a one-piece vest that is designed to be worn over the individual. The patent discloses:

"Disclosed is a protective vest having a collar or neck guard intended for use with helmets and, optionally, with shoulder pads or harnesses, of the types worn by players in contact sports. The protective vest has a flexible body with shoulder portions between chest and back panels. Surrounding an opening for receiving a player's neck is a raised collar, integrally formed with the body, which has an upper ring-like surface for contacting the bottom edge of the player's helmet. When contacted by the player's helmet, the collar, formed of resilient material, is placed in energy-absorbing compression. Also, the chest and back panels surrounding the collar, also being made of resilient material, are placed in a tension and compression loading, to further aid in absorbing the loading applied to the collar. The body portion and, particularly, the chest and neck panels are pliable so as to conform to the topography of the player's upper torso and to frictionally engage the player's body and any clothing in contact with the player's body underneath the protective vest, so as to provide the frictional engagement necessary for efficient energy absorption."

Claim 1 of the patent reads as follows:

"A protective device for use with helmets of the type worn by players in contact sports, comprising:

a flexible body of resilient material having shoulder, chest and back portions covering substantial portions of the shoulders, chest and back of a player respectively, and having a raised resilient collar immediately adjacent a central portion of the device defining an opening for the head of a wearer of the device, said raised resilient collar integrally formed with and continuously joined to said chest and said back portions so as to transmit thereto forces applied to an upper surface of said raised collar by the bottom of a helmet worn by the wearer, said body having an inner surface for frictionally engaging the body of a wearer so as to maintain said device in a preselected position about the body of a wearer so that displacement of said raised resilient collar portion is resisted with a resilient bias force which maintains said collar portion in said preselected position about the body of a wearer."

The Gaines Patent is for a sports helmet for protection of the cervical spine but as you can see it essentially is a contraption that goes along the back of the spine and is attached to the helmet and has various locations by which the amount of tension on the helmet can be adjusted. The patent discloses:

"A flexible support brace transfers excessive back motion of a sports helmet through a flexible interlinked brace, which floats freely between two spaced circumferential spans on the helmet during normal play but which engage with the helmet and collapses to a braced configuration if the helmet is excessively pulled back or pushed forward. In the braced configuration, helmet loads are transferred to the shoulder pads of the player directly thus transferring excessive head loads into the chest area of the player where they can be more safely absorbed."

The Allen Patent is a head restraining system where its major function again is to have various attachments that attach to body portions and then attach to the helmet and which can be adjusted to a specified tightness. The patent discloses:

"A head restraining system including a helmet having a chin protector formed thereon, a keeper plate overlying the shoulders, upper chest, including the sternum area, and upper back of the driver, a plurality of straps connecting the shoulder, chest and back portion of the keeper plate to aligned portions of the helmet and a pair of shoulder straps securing the keeper plate to the driver."

The Phillips Patent is a combination helmet and shoulder protector which includes a rod for adjusting the amount of tension between the pad protector and the helmet. Specifically, the patent discloses:

"The present invention relates to a combination shoulder pad and helmet assembly uniquely designed to protect a user from serious cervical spine injuries. The device comprises a helmet having a mounting bracket on the back portion thereof The mounting bracket has a pair of opposing embrasures in communication with and an axial, cylindrical bore. An elongated tubular rod is received within the bore having an indention at opposing ends thereof. The rod is retained within the bore using a spring biased pin received within the embrasures and the indention which also limits the rotation of the rod relative to the cylindrical bore. The spring biased pin has a concave portion proximal its head which may be selectively aligned with the rod indention to release the rod from the brackets. The opposing end of the rod is secured to a similar bracket and pin mechanism mounted to the top edge of a set of shoulder pads. Furthermore, a mid-torso protective device is secured to the lower edge of the shoulder pads. The assembly is designed to limit the movement of a football player's head relative to the body to minimize the potential for serious, paralyzing cervical injuries as well as to protect the player from breath taking blows to the abdomen."

In addition, Claim 1 of the patent reads as follows:

"A combination shoulder pad and helmet assembly comprising:

a protective spherical shell for receiving and protecting a user's head having a back portion;

a mounting bracket secured to the back portion of said shell having a cylindrical, axial bore therethrough and a pair of embrasures each on an opposing side thereof in communication with said bore;

a tubular rod received within said bore having an indention proximal each end thereof;

a pin received within one of said indentions and said opposing embrasures for limiting the rotation of said tubular rod within said cylindrical bore and for securing said rod therewithin;

a shoulder protecting device having a second attachment bracket thereon, likewise having a cylindrical, axial bore and a pair of embrasures each on an opposing side thereof in communication with said bore for receiving the opposing end of said tubular rod;

a second pin received within said opposing embrasures and the other of said indentions on said tubular rod for limiting the degree of rotation of said rod within said cylindrical bore and for securing said rod therewithin."

The Sledge Patent deals with a head and neck support system. The apparatus discloses:

"An apparatus worn by a driver or user of vehicle: The apparatus has a yoke with an aperture sized to receive a user's head. The head of the user passes through the aperture and the yoke rests on the user's shoulders. The apparatus has two pairs of adjustable juxtaposition elongated substantially L-shaped flanges. The first pair of elongated substantially L-shaped flanges is adjustably connected to a helmet and the second pair is adjustably connected to the yoke. The helmet and second pair of elongated substantially L-shaped flanges arcuately traverse the first pair of elongated substantially L-shaped flanges in the horizontal plane thereby permitting movement of the user's head in the horizontal plane with respect to the user's field of view but preventing movement of the user's head in the vertical plane with respect to the user's field of view."

The Baker Published Patent Application contains a multiplicity of tethers which are attached to the helmet so that it can absorb a force and this is affixed to the structure worn on the body. Claim 1 reads as follows:

"A head stabilizing system for limiting the load acting on a wearer's head and generated by displacement, velocity, or acceleration of the wearer's head with respect to the wearer's body, comprising: a helmet; a connection structure; and at least one resisting member positioned between and connected to the helmet and the connection structure, wherein the at least one resisting member generates a reaction force that substantially opposes a crash impact force to yield a reduced net force on the head."

The Schroth Patent is a restraint system which essentially is designed to affix a person to a vehicle and is different from your invention. The patent discloses:

"A restraint system for restraining a person in a vehicle of transportation, includes a safety harness having length adjustable shoulder belts and a buckle for connecting the shoulder belt on a chest-side of a person and a stiff U-shaped shoulder yoke having legs, which are contoured to a torso of the person, and a high collar interconnecting the legs, whereby the shoulder belts are secured by a fastening mechanism behind the collar. The legs of the shoulder yoke and the shoulder belts have confronting sides which are formed, at least partially, with an interacting engagement structure which is configured to increase friction as the shoulder belts move in relation to the legs in longitudinal direction, while inhibiting a displacement of the shoulder belts in relation to the legs in transverse direction."

Claim 1 reads as follows:

"A restraint system for restraining a person in a vehicle of transportation, comprising: a safety harness having length adjustable shoulder belts and a buckle for connecting the shoulder belt on a chest-side of a person; a stiff U-shaped shoulder yoke having legs, which are contoured to a torso of the person, and a high collar interconnecting the legs; and fastening means for securing the shoulder belts behind the collar, wherein the legs of the shoulder yoke have a side in confronting relationship to a side of the shoulder belts, with the confronting sides formed, at least partially, with an interacting engagement structure which is configured to increase friction as the shoulder belts move in relation to the legs in longitudinal direction, while inhibiting a displacement of the shoulder belts in relation to the legs in transverse direction."

The '747 Baker Patent is not the same as but is related to the previously discussed Baker Published Patent Application and once again discloses the concept of a head stabilizing system affixed to the helmet and then affixed to a body component so that the tethers can cause the shock to be absorbed. By way of example, Claim 1 reads as follows:

"A passive head stabilizing system for limiting the load acting on a wearer's head and generated by displacement, velocity, or acceleration of the wearer's head with respect to the wearer's body, comprising: a passive resisting member having first and second ends, at least the first end being configured to be pivotably connected to another structure; a helmet mount connector configured to pivotably connect the passive resisting member to a helmet, the helmet mount connector being pivotably connected to the first end of the passive resisting member; and a harness connector configured to engage at least a portion of a safety harness of a vehicle and movable relative to the safety harness while engaging the harness, the harness connector being connected to the second end of the passive resisting member."

The Nagley Patent deals with a protective helmet which again has a strut member which is attached to the back of the vest worn so that the strut member can absorb the shocks through the helmet by being attached to the helmet. Claim 1 reads as follows:

"A motion restrictor device adapted for use with a protective helmet having an upper wall, two side walls, and a back wall, comprising: a force sensor adapted to be disposed adjacent the upper wall of the protective helmet; at least one strut member having first and second ends, the first end of the at least one strut member adapted to be associated with one of the walls of the protective helmet and the second end of the at least one strut member adapted to be associated with a harness assembly; the at least one strut member permitting relative motion between the first and second ends of the at least one strut member; and a locking assembly associated with the at least one strut member, and the locking assembly, upon a predetermined force being sensed by the force sensor, having a first locked configuration stopping substantially all relative motion between the first and second ends of the at least one strut member."

The Mazzarolo Published Patent Application discloses:

"A collar for protecting the neck of a user, useful in particular for motorcycle riders, is envisaged, said collar comprising two half-collars which are pivotably hinged together at one end so as to be rotatable in a substantially horizontal plane and which can be connected together by means of a fastening and release lever, a safety structure which at the rear extends downwards from the bottom edge of the collar so as to be centered with respect to the spinal column of the user, and a protective shield which extends downwards at the front. The safety structure has a breakable structure made of the material with an impact strength lower than the material forming the collar so as to break in a programmed manner in the event of impacts following falls."

The Kordecki Published Patent Application discloses the concept of a protective shoulder pad with release mechanisms. Specifically, the patent discloses:

"This invention concerns protective shoulder pads (2) having a release mechanism (7). The shoulder pads (2) protect an individual wearing the protective shoulder pads (2) against impact to the superior, anterior, posterior and/or lateral regions of the shoulder and upper arm. Release mechanism (7) allows the protective shoulder pads (2) to be more safely and easily removed from the individual wearing the protective shoulder pads (2) while the individual wearing the protective shoulder pads (2) is maintained in the supine position, thus decreasing the risk of further injuring the individual wearing the protective shoulder pads (2)."

The '0041240 Mazzarolo Published Patent Application discloses:

"A protective device for the neck, such as a neck brace (12), with a substantially rigid closed structure around the neck and adapted to sit on the user's torso comprises means for temporarily changing the device's shape so as to reduce the natural gap between the upper brace surface and the lower rim of the helmet (10), thereby creating a supplementary transmission path for compressive forces exerted upon the device towards the torso."

The Russian Patent abstract reads as follows:

"FIELD: medicine. SUBSTANCE: left-hand on-back vertical flat sling and right-hand on-back vertical flat sling from seat with crossed loop branches of left and right0hand leg femurs. Seat loops are secured to each other rigidly at an angle of 70-120 deg. In this case, one chest and one on-back vertical slings cross on the side, and at their intersection points they are secured by moving stop elements fixing the slings at an angle and adjusting the size of the loops of left and right-hand leg femurs. Two on-back vertical slings are connected to each other by flat horizontal moving tape fixed at required height by stop elements and supporting the back. Two chest vertical slings are joined together by flat horizontal moving tape fixed by means of stop elements at required height. Rotator serves to suspend protective girdle to adjustable shock-absorbing system to force tie-rods. Protective girdle may include additionally helmet-shaped member designed to support patient's had. The member is secured to a distance force plate by flexible adjustable suspension. Helmet-shaped member is made sectional. EFFECT. Enlarged degree of patient's freedom."

There is a significant need for an apparatus which can be used in conjunction with a crash helmet to limit injuries to a rider which occur during a motorcycle racing crash.

SUMMARY OF THE INVENTION

The present invention is an apparatus to be worn on an individual's shoulders, chest and back below a full face helmet to limit the occurrence of cervical spinal cord injuries in the event of a crash.

The present invention is a neck protector which comprises a left main frame which extends from an upper section and curves forwardly to a left main frame chest covering section which at its lower innermost portion includes a male interconnecting member. Extending from its front, the left main frame has a chest support member. Extending from its rear, the left main frame has a back support member supported on a connection member which has a separate left axle receiving opening and a closing nut. Underneath the upper section is a shoulder padding and if desired, an additional optional shoulder padding to help cushion any blows the rider may receive.

The right main frame is substantially a mirror image of the left main frame. The right main frame extends from an upper portion and curves forwardly to the right main frame chest covering section which at its lower innermost portion includes a female interconnecting member. The left main frame and right main frame are interconnected at their bottom portions by a front axle so that the left main frame section and right main frame section can be pushed together at their lowermost portions by having the male interconnecting member inserted into the female interconnecting member by sliding along the front axle. A front axle nut helps tighten the left main frame to the right main frame. Extending from its front, the right main frame has a chest support member. Extending from its rear, the right main frame has a back support member supported on a connection member which has a separate right axle receiving opening with a separate tightening nut. The second right rear axle extends through an axle receiving opening and is tightened by a nut so that the upper portion of the main frames are rotatable. There are separate receiving openings between the left main frame and right main frame with each axle having a separate tightening nut. Underneath the right upper section is a shoulder padding and if desired, optional additional shoulder padding.

It is a further object of the present invention to provide a chest support wherein the chest support sits on either side of the individual's sternum. This will limit the ability of the individual to suffer a fracture from a force applied by a support system. The chest supports are fastened to the support system by way of single axle and nut. These supports may also be fastened to the support system by any other desired fastening mechanism.

It is a further object of the present invention to provide independently rotatable, adjustable back support systems which are designed to sit on either side of the user's spinal cord. This dual support system further reduces the ability to suffer injury when forces are applied through the back, since it does not sit directly on the spinal cord. These back supports are mounted through adjustable mounts. Use of this mounting system allows for forward, rearward; upward, downward, angular, or any combination of adjustments through different mounting options.

It has further been discovered that by having the invention split, the two-part frame allows the individual to remove the device safely and easily in the event of an accident. The invention's main frame is two separate parts, joined in the front of the invention by a single male/female insert system that pulls apart horizontally with the simple removal of the front axle and nut. This split two-part frame allows for an emergency release system that is unique to the present design. The split, two-part design also allows the entire support system to flex vertically upward and downward to create mobility and comfort for the user.

Each chest support system has independent padding which rests against the user's chest. Each back support system has independent padding which rests against the user's back. Both of these chest and back padding systems are designed to help disperse energy when in contact between two hard surfaces (i.e. the invention's back supports, and a body) during an accident, or harsh impact. The specific cutout pattern of the padding, along with its material properties allow this padding to reduce harsh impacts by dispersing energy before it reached the body, further adding to the safety for the user.

It is a further object of the present invention to incorporate padding underneath the shoulders of the present invention structure to reduce impact by the dispersion of energy.

The present invention is the only device with shoulder padding that extends long enough to cover the user's collarbone, whereas no previous invention in this area does this. The shoulder padding has two layers, one layer of which is optional. The dual layer padding allows for optional height adjustment of the invention, incase a specific user has a longer neck and therefore needs the invention to sit higher on his or her shoulders.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a helmet stabilizer or neck protection device that is designed to be used in conjunction with a full face helmet in order to enable a user to potentially reduce the chance of a cervical spine injury and at the same time enable the user to remove the device in an easy manner in the event of an accident.

Figure 1:
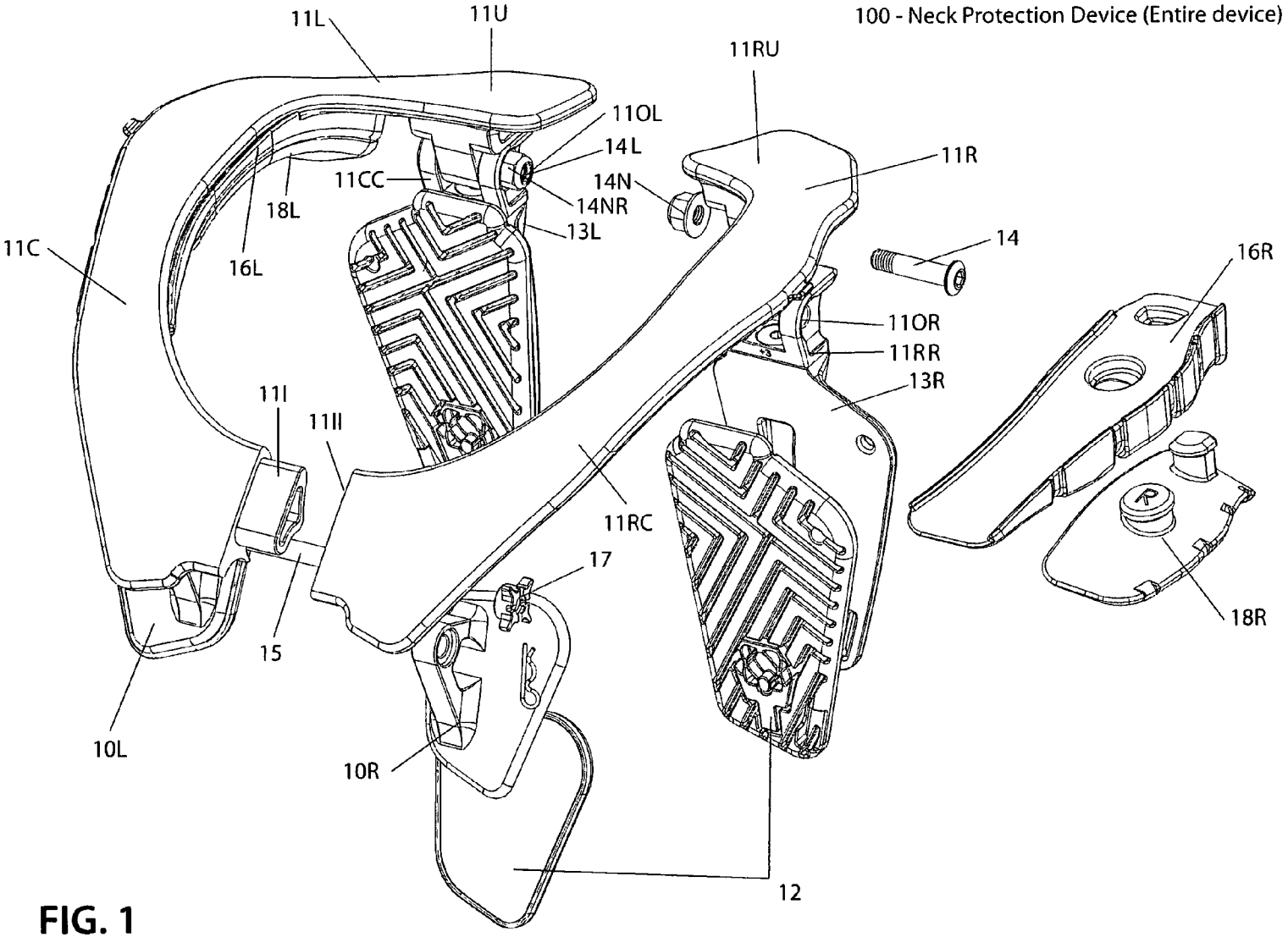
FIG. 1 is an exploded view illustrating all components of the present invention.

Referring to FIG. 1, there is illustrated an exploded view of the components of the present invention helmet stabilizer or neck protection device 100 with the separate components clearly illustrated. The numbering is also placed in subsequent drawings for clarity. The helmet stabilizing or neck support device 100 comprises a left main frame 11L which extends from an upper section 11U and curves forwardly to a left main frame chest covering section 11C which at its lower innermost portion includes a first interconnecting member which can be a male interconnecting member 11I. Extending from its front, the left main frame 11L has a chest support member 10L. Extending from its rear, the left main frame 11L has as back support member 13L supported on a connection member 11CC which has an axle receiving opening 11O. Underneath the upper section 11U is shoulder padding 16L and if desired, additional optional shoulder padding 18L.

The right main frame is substantially a mirror image of the left main frame. The right main frame 11R extends from an upper section 11RU and curves forwardly to the right main frame chest covering section 11RC which at its lower innermost portion includes a second mating interconnecting member which can be a female interconnecting member 11II The left main frame 11L and right main frame 11R are interconnected at their bottom portions by a front axle 15 so that the left main frame section 11L and right main frame section 11R can be pushed together at their lowermost portions by having the male interconnecting member 11I inserted into the female interconnecting member 11II by sliding along front axle 15. Front axle nut 17 helps tighten the left main frame 11L to the right main frame 11R. The front axle 15 holds everything together. Extending from its front, the right main frame 11R has a chest support member 10R. Extending from its rear, the right main frame 11R has a back support member 13R supported on a connection member 11RR which has an axle receiving opening 11OO. There are two separate rear axle assemblies (left and right). Left rear axle 14L extends through left axle receiving opening 11OL and is tightened by nut 14N to allow the left back support to be fastened to the left main frame, and also create a point of rotation about the axle to allow the left back support to fold inward. The dual system causes the back supports 13L and 13R to rotate (fold). It is the back supports which form the rotation. Similarly, a right rear axle 19R extends through axle receiving opening 11OR and is tightened by nut 14NR so that the upper portion of right main frame 11R is tightened. Underneath the right upper section 11RU is shoulder padding 16R and if desired optional additional shoulder padding 18R.

With the present invention described in detail above, additional features of the invention will now be described.

The invention's front, dual, independently rotating chest supports 10L and 10R are designed to sit on either side of the individuals sternum, limiting the ability to suffer a fracture from a force applied by the support system. These chest supports 10L and 10R are fastened to the support system by way of single axle and nut 15 and 17. These supports may also be fastened to the support system by use of single bolt and nut, dual bolt and nut, single axle and nut, dual axle and nut, single quick release pin system, or dual quick release system. This fastening system may also include rubber bushing(s), or insert(s) to allow the said fasteners to be rubber mounted to the support system.

The invention's dual, independently rotating, adjustable back support system 13L and 13R is designed to sit on either side of the users spinal cord. This dual support system further reduces the ability to suffer injury when forces are applied through the back, since it does not sit directly on the spinal cord. These back supports are mounted via adjustable mounts. Use of this mounting system allows for forward, rearward, upward, downward, angular, or any combination of said adjustments via different mounting options supplied with the support system.

The invention's split, two-part frame allows the individual to remove the device safely and easily in event of an accident. The invention's main frame is two separate parts, joined in the front of the invention by a single male/female insert system 11I and 11II that pulls apart horizontally with the simple removal of the front axle and nut 15 and 17. (And can be re-assembled in the reverse order an endless amount of times). This split two part frame allows for an emergency release system that is unique to this design. The split, two part design also allows the whole support system to flex vertically upward and downward to create mobility and comfort for the user.

The invention uses padding materials 12 and patterns specifically designed to reduce impacts by the dispersion of energy. When in contact with two solid surfaces, the cut out pattern of the material (and the material properties itself) drastically reduce harsh impacts by dispersing the load in a forty-five degree angle direction from the load being applied. This further reduces the ability of injury sustained to the users body during an accident.

The invention's chest and back support rotation systems allow the invention to be folded for easy storage, with no disassembly of the system.

Figure 20:
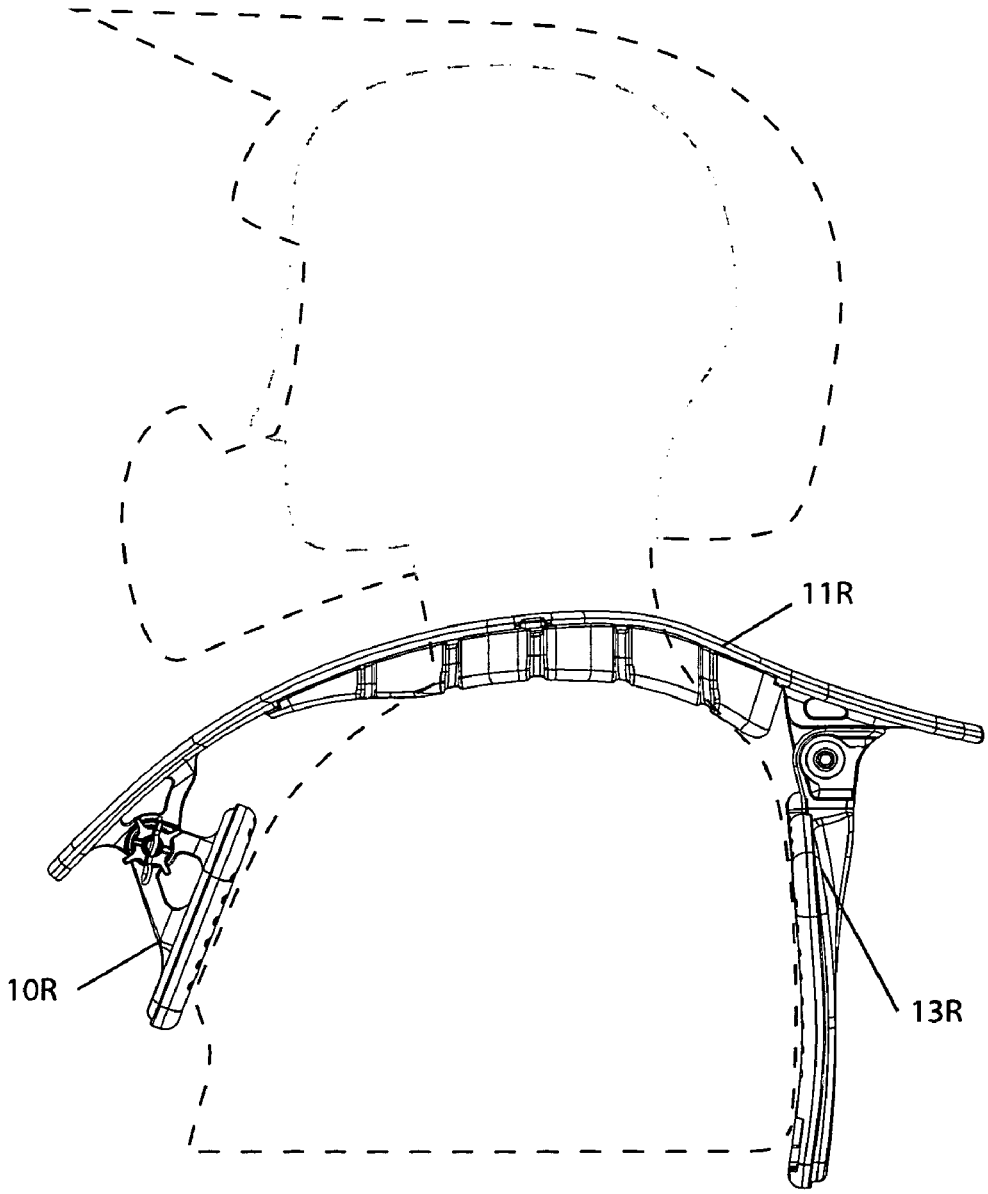
FIG. 20 is a perspective view showing the present invention in place on a person and the crash helmet in place worn on a person's head above the present invention, with the crash helmet shown in dotted lines and forming no part of the invention, and also a person wearing the crash helmet, the person also shown in dotted lines.

As illustrated In FIG. 20, the top of the main frame curvature of the invention acts as stopping points for the users full face helmet, so that the helmet can stop rotation before it reaches the body, which can reduce the chance for injury. These stopping points of the helmet are designed to prevent the following extreme movements: Hyper Flexion (head forward), Hyper Extension (head backwards), Lateral Hyper Flexion (head sideways), Posterior Hyper Translation (head/helmet reward on the neck), Axial loading (spinal column compression) two-part design also allows the whole support system to flex vertically upward and downward to create mobility and comfort for the user.

The invention uses padding materials 12 and patterns specifically designed to reduce impacts by the dispersion of energy. When in contact with two solid surfaces, the cut out pattern of the material (and the material properties itself) drastically reduce harsh impacts by dispersing the load in a forty-five degree angle direction from the load being applied. This further reduces the ability of injury sustained to the users body during an accident.

As illustrated in FIGS. 13 through 19, the invention's chest and back support rotation systems allow the invention to be folded for easy storage, with no disassembly of the system.

Operation:

The user simply holds the invention by the main frame 11L/11R and places it over his/her head, lowering the support system down until contact is made between the shoulders and shoulder supports 16L/16R, the chest and chest supports 10L/10R, and the back and back supports 13L/13R. Once in place, the chest supports 10L/10R will rest on the users chest around the sternum, and the back supports 13L/13R will rest on the users back, to the left and right of the spine.

To adjust the height of the support system (the distance between the main frame 11L/11R, and the users shoulders) the user can simply opt to use the additional layer of padding supplied (18R/18L) with the system. Height adjustment is necessary depending on the users neck length and mobility while using the support system.

Once in place on the user's body, and a full face helmet is used in conjunction with the support system, activity and/or sport may take place. During an accident, the support system will provide alternative stopping points for the full face helmet, limiting movement, and lowering the potential risk of a cervical spine injury.

To use the emergency release system and disassemble the support system, the user removes the front axle nut 17 and then pulls the two main frame components 11L/11R apart horizontally off the user.

Figure 2:
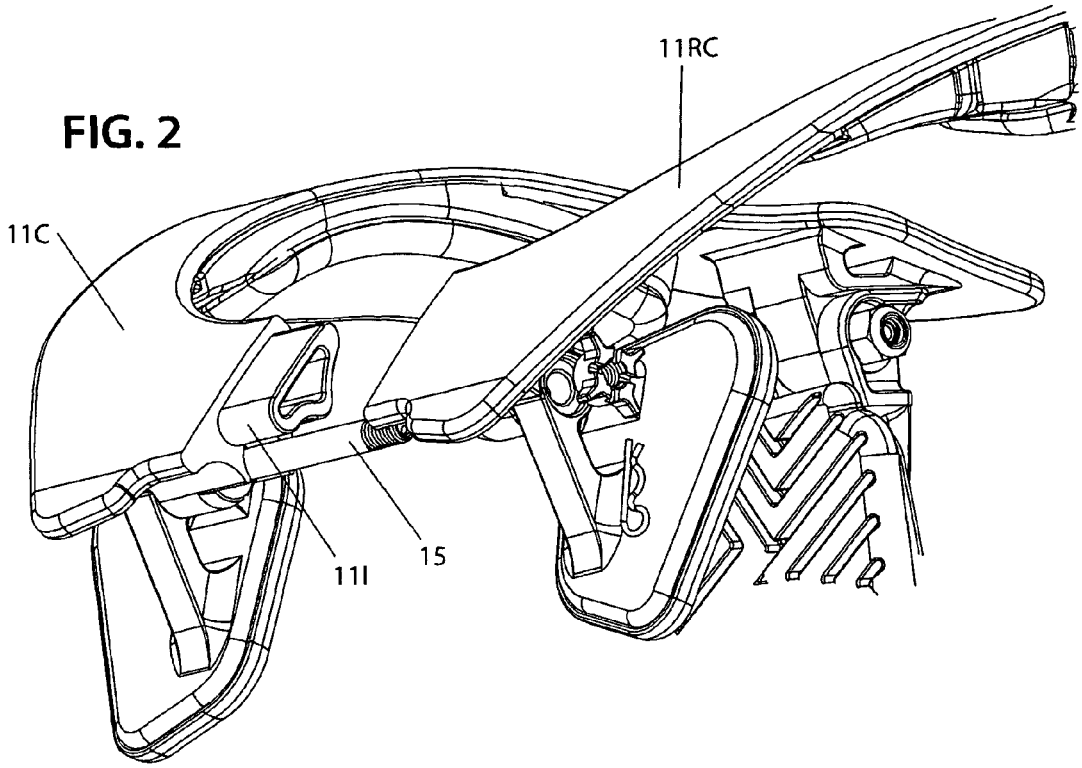
FIG. 2 illustrates a partially unassembled perspective view of the device showing the left main frame's male connector separated from the right main frame assembly, as it would be disassembled following an accident or crash. At this point no rotation occurs, only a horizontal pull to separate the two halves of the device.
Figure 3:
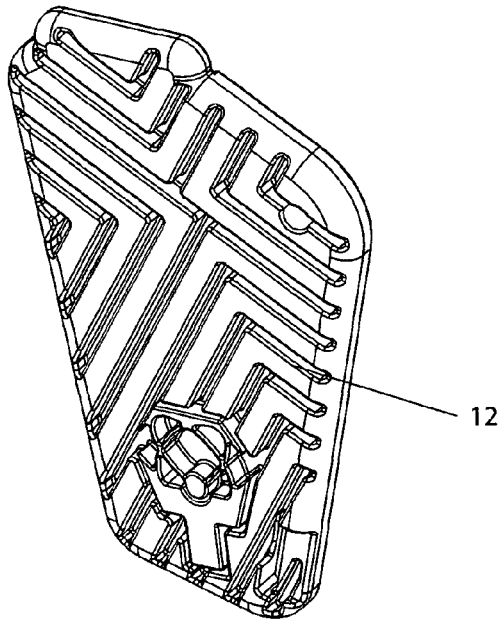
FIG. 3 is a perspective view of the padding used with the present invention showing multiple gaps in the padding.
Figure 4:
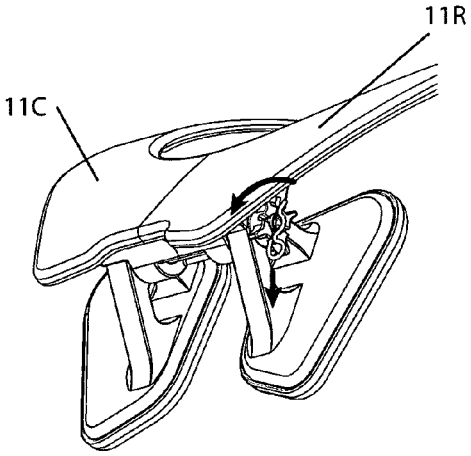
FIGS. 4 and 4A is a perspective view of the release system of the present invention showing that the nut can be released from the axle at the front and then the device pulled apart.
Figure 4A:
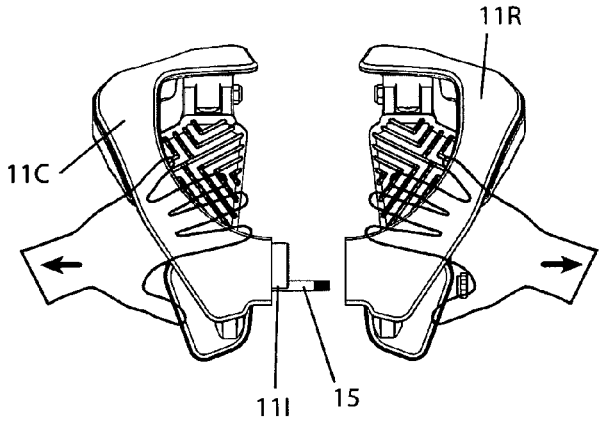
Figure 5:
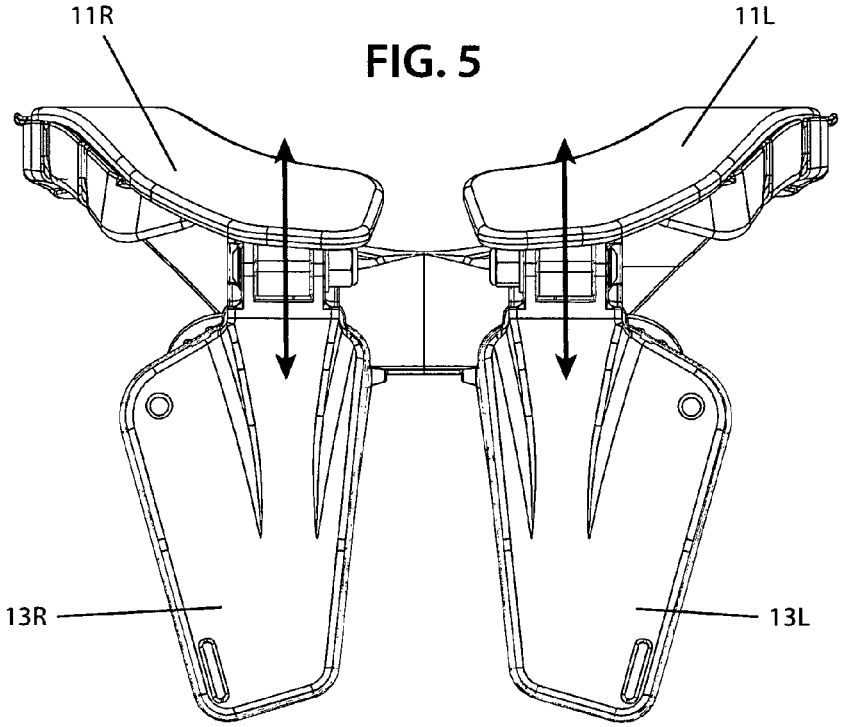
FIG. 5 is a split frame vertical flexibility view showing the present invention.
Figure 6:
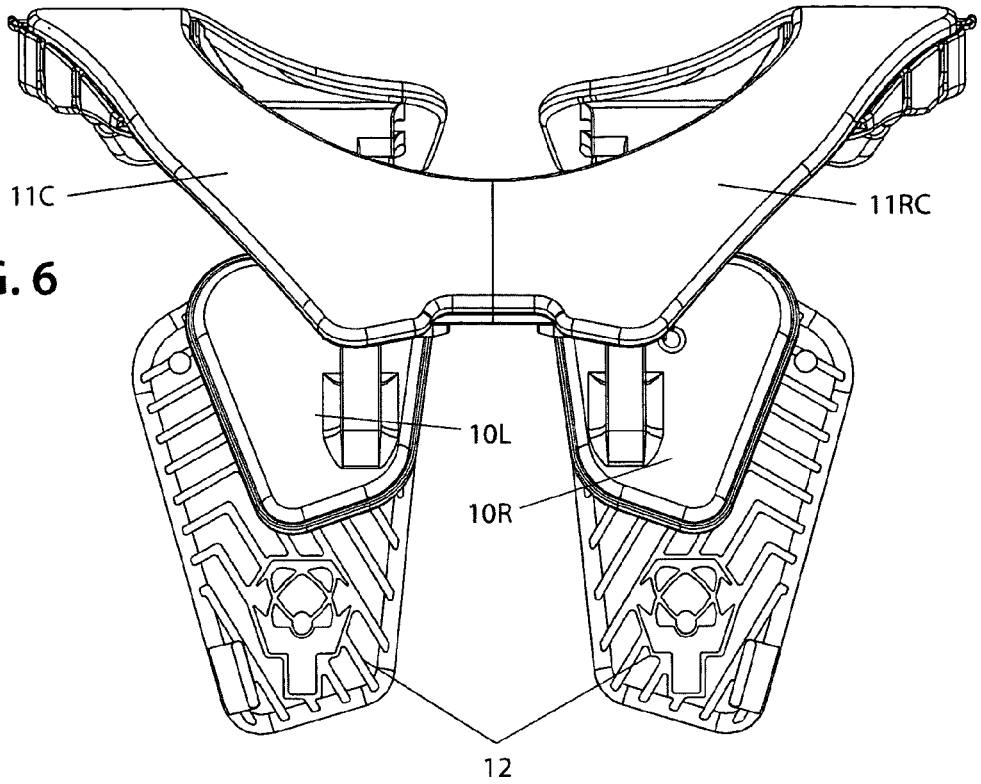
FIG. 6 is a front elevational view of the present invention in the opened in-use condition as it would be worn by an individual.
Figure 7:
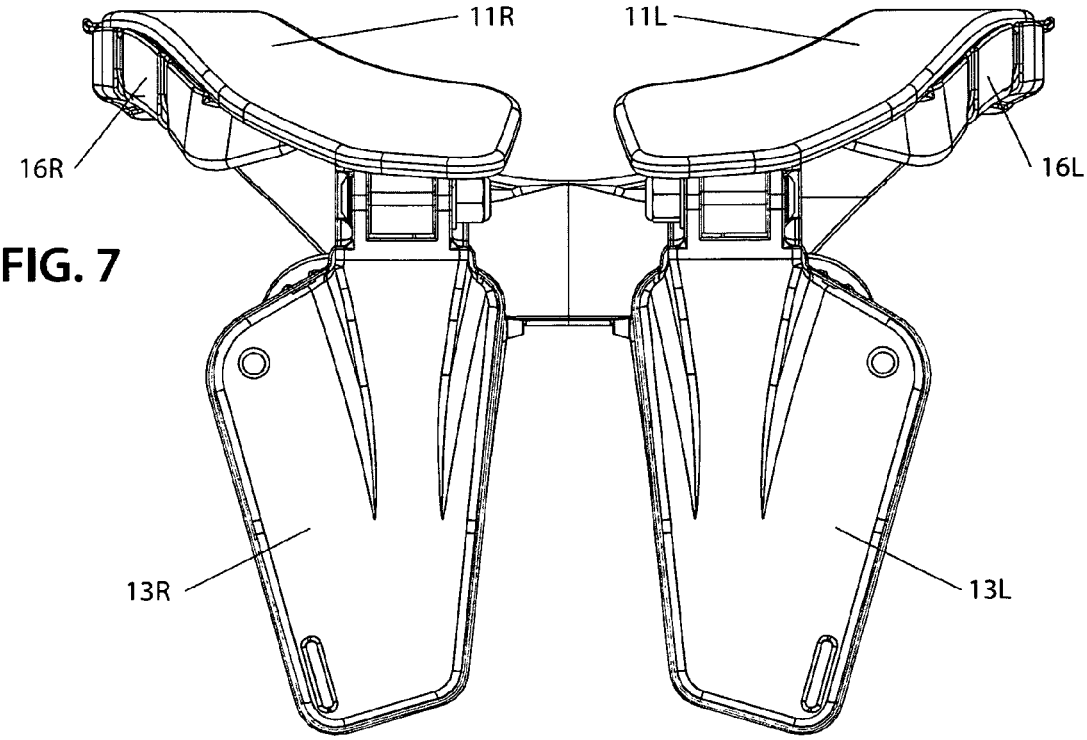
FIG. 7 is a rear elevational view of the present invention in the opened in-use condition as it would be worn by an individual.
Figure 8:
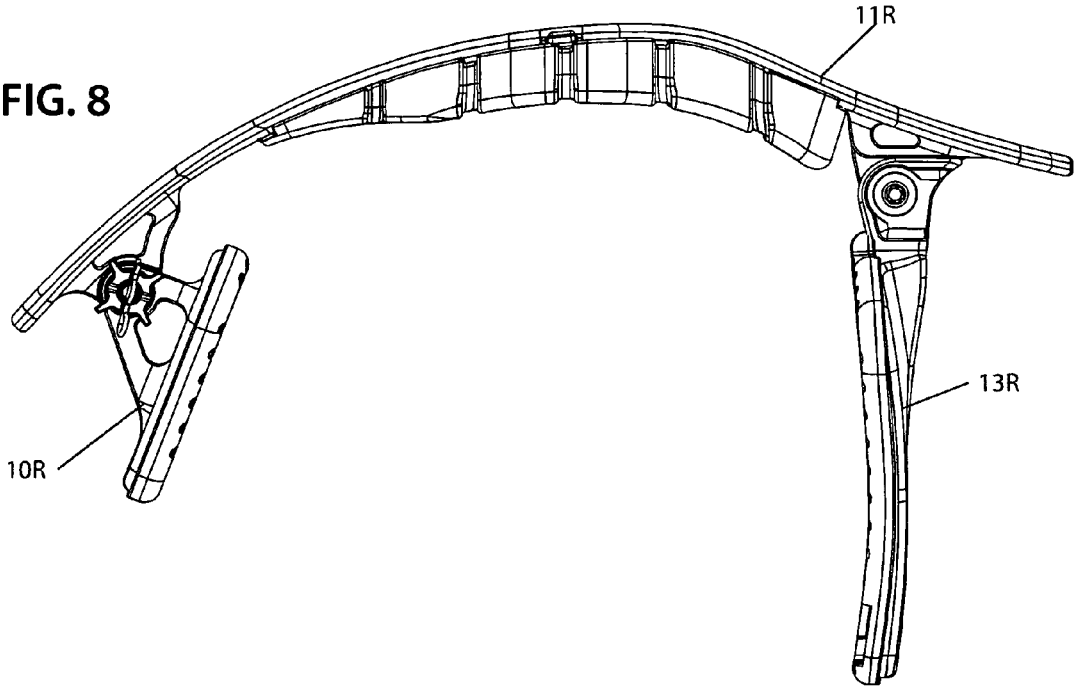
FIG. 8 is a side elevational view of the present invention in the opened condition when viewed from the right side.
Figure 9:
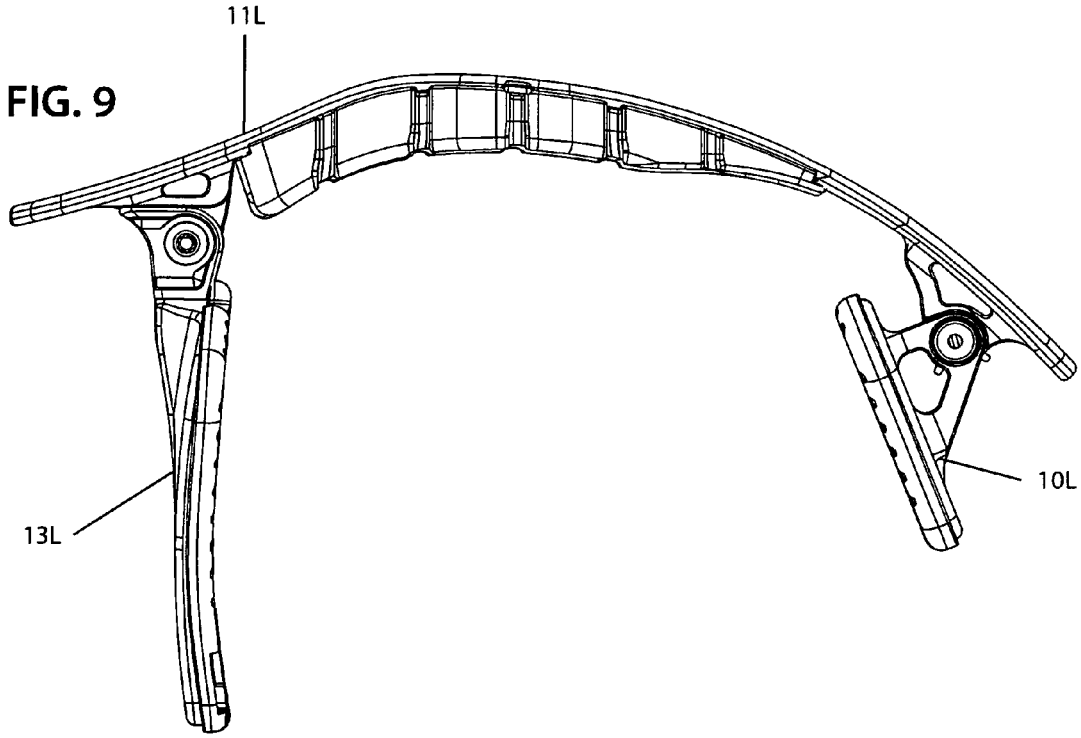
FIG. 9 is a side elevational view of the present invention in the opened condition when viewed from the left side.
Figure 10:
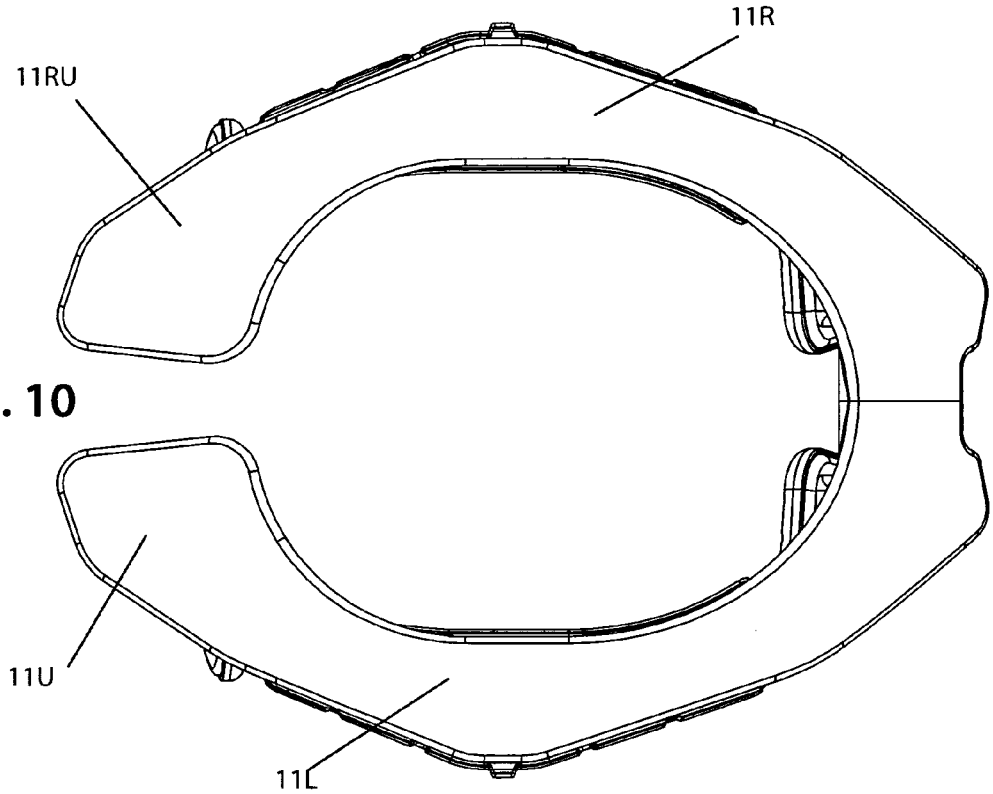
FIG. 10 is a top plan view of the present invention in the opened condition.
Figure 11:
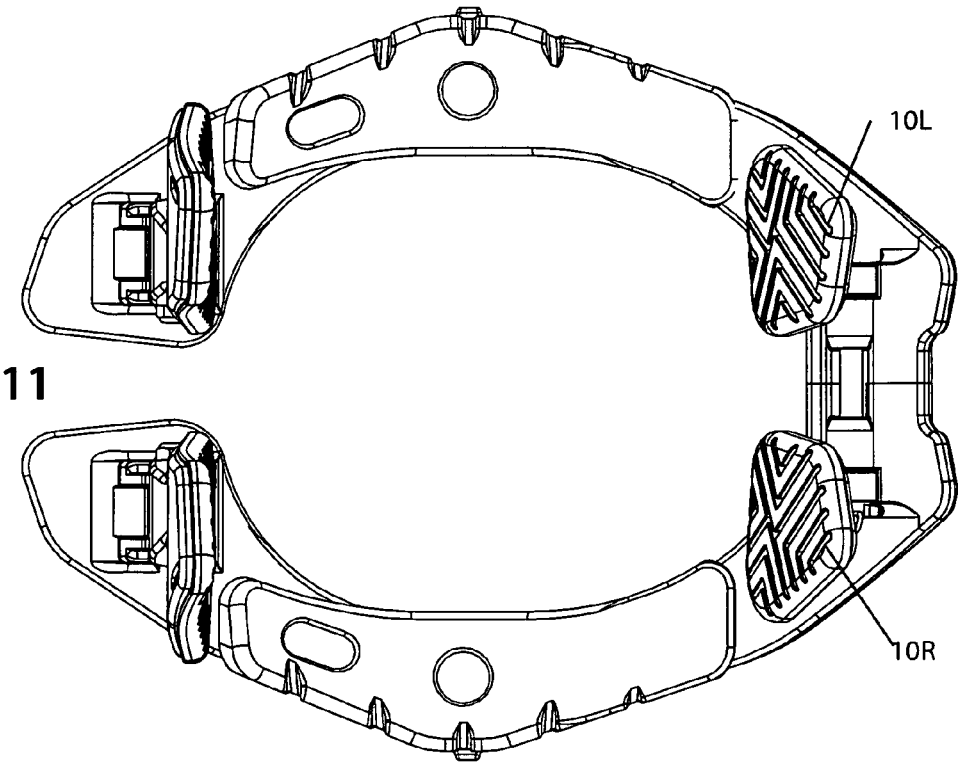
FIG. 11 is a bottom plan view of the present invention in the opened condition.
Figure 12:
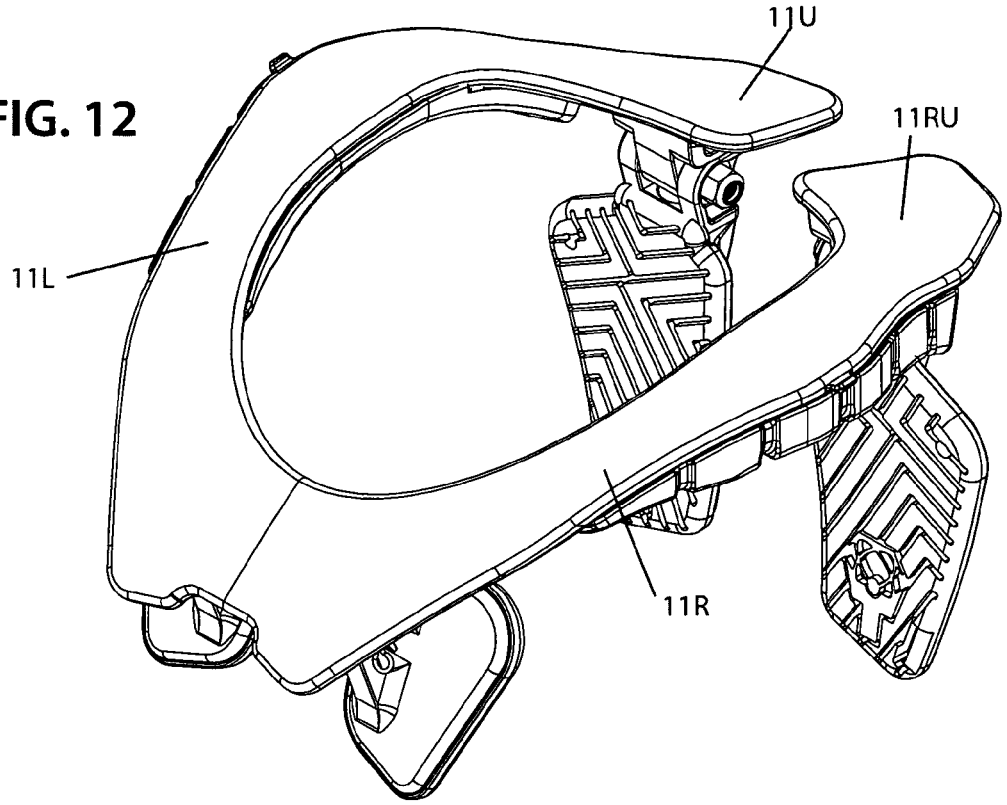
FIG. 12 is a perspective view of the present invention in the opened condition as it would be worn by an individual.
Figure 13:
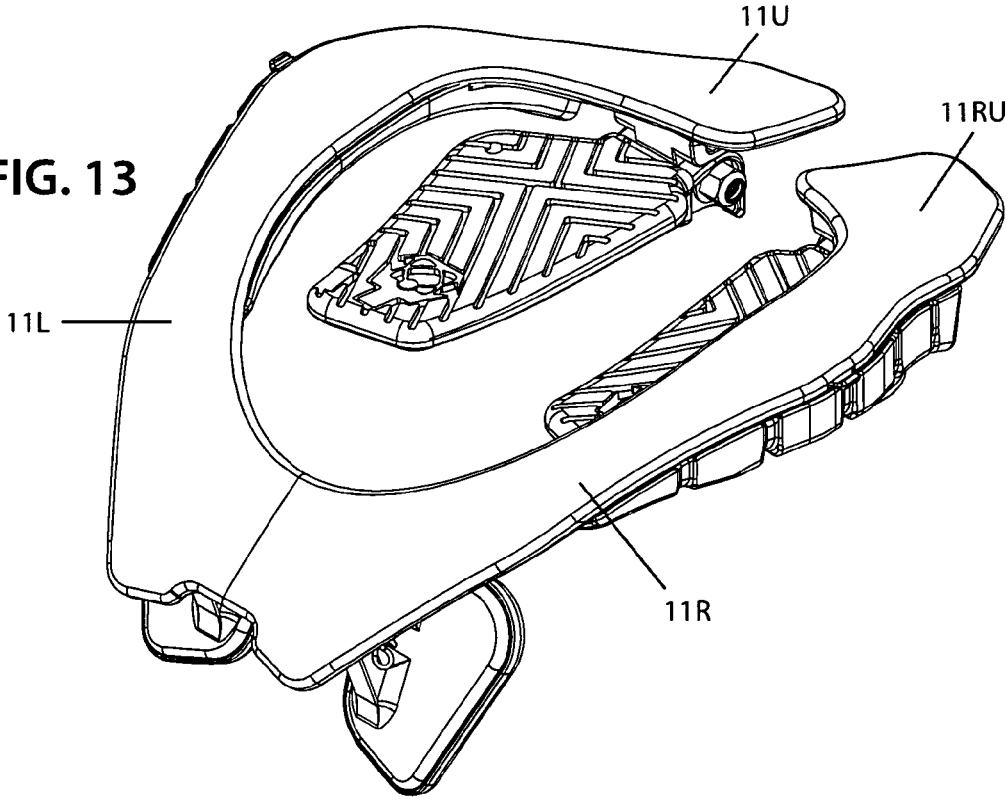
FIG. 13 is a perspective view of the present invention in the closed condition when put away for storage.
Figure 14:
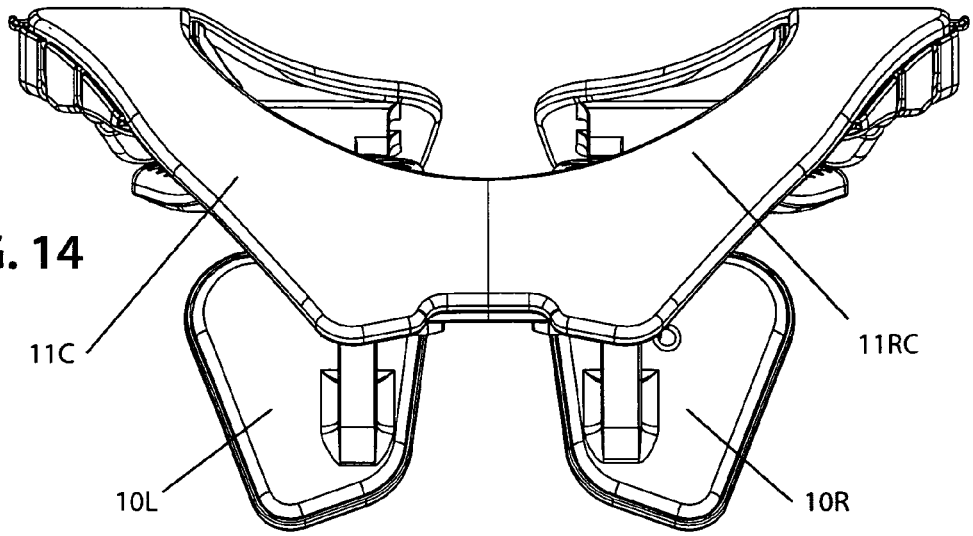
FIG. 14 is a front elevational view of the present invention in the closed condition.
Figure 15:
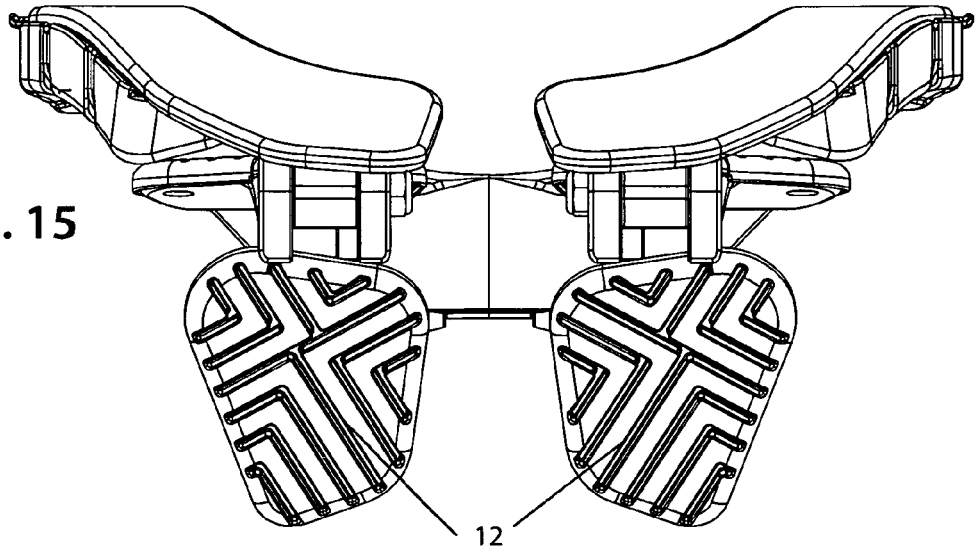
FIG. 15 is a rear elevational view of the present invention in the closed condition.
Figure 16:
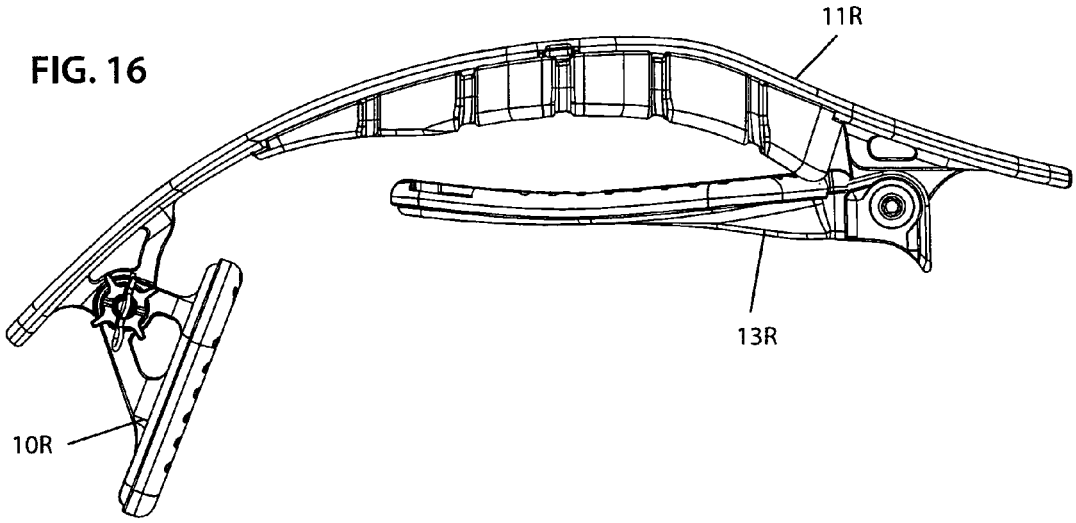
FIG. 16 is a side elevational view of the present invention in the closed condition when viewed from the right side.
Figure 17:
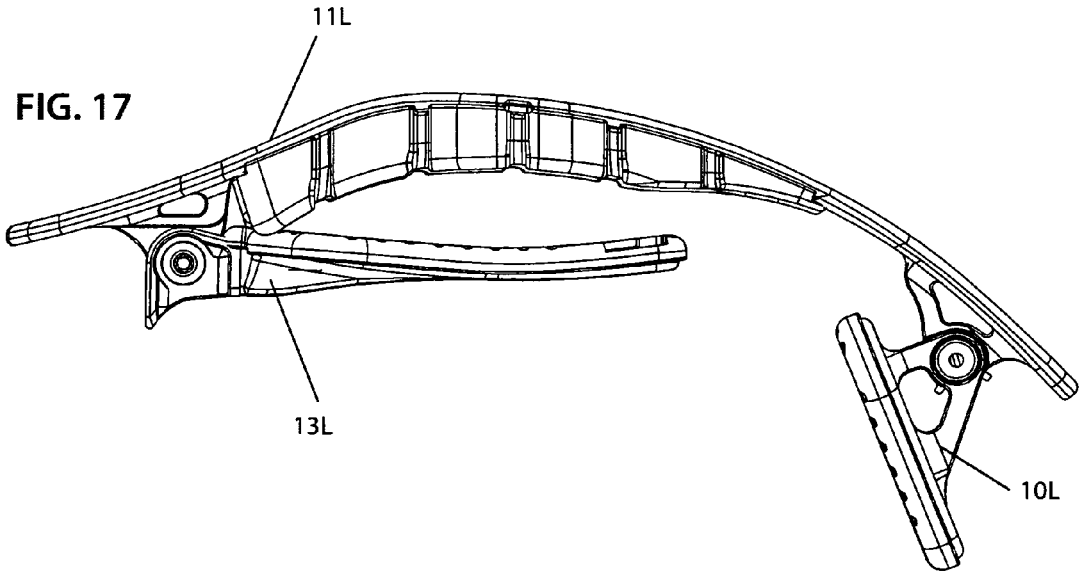
FIG. 17 is a side elevational view of the present invention in the closed condition when viewed from the left side.
Figure 18:
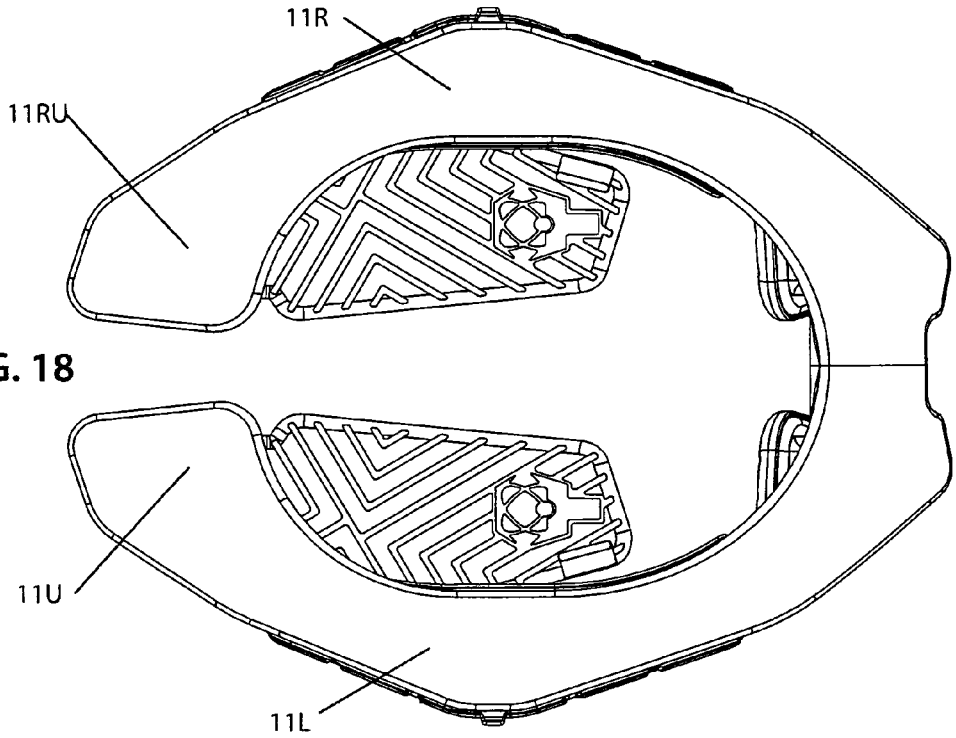
FIG. 18 is a top plan view of the present invention in the closed condition.
Figure 19:
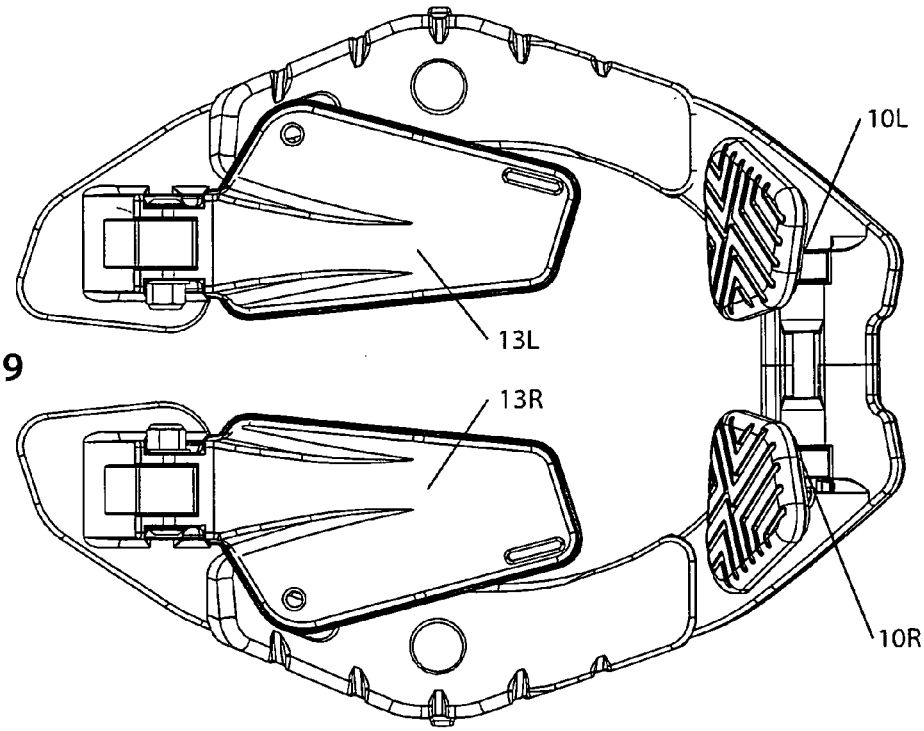
FIG. 19 is a bottom plan view of the present invention in the closed condition.

A left shoulder pad section consists of padding material and a center front axle with interior left and right rotating chest support. There is also an optional shoulder padding section in order to have the device rest on the individual's shoulders at a defined height so the device correctly fits on the user's shoulders, chest and back. There is also the mainframe 11L. There is the right main frame which is affixed to the left main frame by a second axle 15. There is also a back support on the right side and the left side and the back of the device also has interior padding which runs along either side of the spine to help protect the spine from injury. The device is shown fully assembled in FIG. 2 wherein effect the device will fit over the user's head and torso with front pads to protect the individual's chest and back padding on either side of the individual's spine to protect the individual's spine from injury. FIGS. 4, and 4A show the function of the emergency release system. This system allows the device to be disassembled and removed from the user safely in the event of an accident, without any head or neck movement, or helmet removal. During normal use, the user can simply lift the brace off over the user's head after the helmet has been removed. Therefore, the system requires no disassembly which is safe if there is no accident. However, this may not be a safe process following an accident as it requires the helmet to be removed, and also head and neck movement. The front view shown in the picture clearly shows the padding on the back which is designed to rest against the individual's shoulders and also for protecting the individual's spine. This is shown to the right in a side view. The upper sections can also be rotated away so that they can be easily removed and then there is front padding which is much smaller to protect the chest. The front padding and chest supports or back support to which they are attached concurrently rotate in use and are also rotatable as indicated in the picture.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A neck protector comprising:

a. a left main frame which extends from an upper section and curves forwardly to a left main frame chest covering section which at its lower innermost portion includes a first interconnecting member, the left main frame has a chest support member extending from its front, the left main frame has a back support member supported on a connection member which has a separate left axle receiving opening and a closing nut, underneath the upper section is a shoulder padding; and b. a right main frame which extends from an upper section and curves forwardly to a right main frame chest covering section which at its lower innermost portion includes a second mating interconnecting member, the left main frame and right main frame are interconnected at their bottom portions by a front axle so that the left main frame section and right main frame section can be pushed together at their lowermost portions by having the first interconnecting member coupled with the second mating interconnecting member by sliding along the front axle, a front axle nut is used to tighten the left main frame to the right main frame, extending from its front, the right main frame has a chest support member, extending from its rear the right main frame has a back support member supported on a connection member which has a separate right axle receiving opening with a separate tightening nut, the second right rear axle extends through an axle receiving opening and is tightened by a nut so that the upper section of the main frames are rotatable underneath the upper section on the shoulder padding.

2. The neck protector in accordance with claim 1, further comprising: separate receiving openings between the left main frame and the right main frame, with each axle having a separate tightening nut.

3. The neck protector in accordance with claim 1, the chest support used in conjunction with an individual's sternum by sitting on either side of the individual's sternum which will limit an individual from suffering a fracture from a force applied by a support system.

4. The neck support system in accordance with claim 1, further comprising: the chest supports are fastened to the support system by way of a single axle and a single nut.

5. The neck protector in accordance with claim 1, further comprising:

a. independently rotatable adjustable back support systems which are designed to be used in conjunction with and to sit on either side of the user's spinal cord, so that this dual support system further reduces the likelihood of injury when forces are applied through the back, since it does not sit directly on the spinal cord; and b. the back supports are mounted through adjustable mounts and use of this mounting system allows for forward, rearward, upward, downward, angular, or any combination of adjustments through different mounting options.

6. The neck support in accordance with claim 1, further comprising:

a. having the neck support split, the two-part frame allowing an individual to remove the device safely and easily in the event of an accident;

b. the neck support main frame is two separate parts, joined in the front by a single male/female insert system that pulls apart horizontally with the simple removal of a front axle and nut, this split two-part frame allows for an emergency release system that is unique to the present design; and c. the split, two-part design also allows the entire support system to flex vertically upward and downward to create mobility and comfort for the user.

7. The neck support system in accordance with claim 1, further comprising:

a. each chest support system has independent padding which rests against the user's chest;

b. each back support system has independent padding which rests against the user's back; and.

c. each of the chest and back padding systems designed to help disperse energy when in contact between two hard surfaces, the specific cutout pattern of the padding, along with its material properties, allowing this padding to reduce harsh impacts by dispersing energy before it reaches the body, further adding to the safety of the user.

8. The neck projector in accordance with claim 7, further comprising:

a. the incorporation of padding underneath the shoulders which extends along a user's collarbone to reduce impact by the dispersion of energy.

9. The neck protector in accordance with claim 8, further comprising:

a. a dual layer padding allows for optional height adjustment of the neck protector in case a specific user has a longer neck and therefore needs the invention to sit higher on his or her shoulders.

10. A helmet stabilizing device, comprising:

a. a left main frame which extends from an upper section having a generally flat upper surface which extends with a first left surface to the left of the upper surface and then curves forwardly to a left main frame chest covering section which at its lower innermost portion includes a first interconnecting member, the left main frame covering section extends from its front to a chest support member;

b. the left main frame member further comprises a back support member which extends below the left upper section, the back support is supported on a connection member;

c. underneath the left main frame upper section first left surface is left shoulder padding;

d. a right main frame which extends from an upper section having a generally flat upper surface which extends with a first right surface to the right of the upper surface and then curves forwardly to a right main frame chest covering section which at its lower innermost portion includes a second mating interconnecting member, e. the right main frame covering section extends from its front to a chest support member, the right main frame member further comprises a back support member which extends below the right upper section, the back support is supported on a connection member;

f. underneath the right main frame upper section first right surface is right shoulder padding;

g. the left main frame and right main frame are interconnected at their bottom portions by a front axle so that the left main frame section and right main frame section can be pushed together at their lowermost portions by having the first interconnecting member coupled with the second interconnecting member by sliding along the front axle, and a front axle nut helps tighten the left main frame to the right main frame, the front axle holds everything together; and h. extending from its front, the right main frame has a chest support member extending from its front, the right main frame has a back support member supported on a connection member which has an axle receiving opening, there are two separate rear axle assemblies, left and right, the left rear axle extends through the left axle receiving opening and is tightened by a nut to allow the left back support to be fastened to the left main frame, and also create a point of rotation about the axle to allow the left back support to fold inward, this dual system causes the back supports to rotate or fold, similarly, a right rear axle extends through axle receiving opening and is tightened by a nut so that the upper portion of right main frame is tightened to allow the right back support to be fastened to the right main frame, and also create a point of rotation about the axle to allow the right back support to fold inward, this dual system causes the back supports to rotate or fold.

11. A helmet stabilizing device in accordance with claim 10, further comprising:

a. the independently rotating chest supports are designed to be used in conjunction with an individual's sternum and sit on either side of the individual's sternum, limiting the likelihood of an individual suffering a fracture from a force applied by the support system;

b. the chest supports fastened to the support system selected from the group consisting of a single axle and nut, a single bolt and nut, dual bolt and nut, single axle and nut, dual axle and nut, single quick release pin system, or dual quick release system; and c. the selected fastening system also includes rubber bushings or insert to allow the fasteners to be rubber mounted to the support system.

12. The helmet stabilization device in accordance with claim 10, further comprising:

a. the dual, independently rotating, adjustable back support system is used in conjunction with an individual's spinal cord and is designed to sit on either side of the user's spinal cord, the dual support system further reduces the likelihood of an individual suffering injury when forces are applied through the back, since it does not sit directly on the spinal cord; and b. the back supports are mounted via adjustable mounts and use of this mounting system allows for forward, rearward, upward, downward, angular, or any combination of said adjustments via different mounting options supplied with the support system.

13. The helmet stabilization device in accordance with claim 10, further comprising:

a: the split, two-part frame allows an individual to remove the device safely and easily in the event of an accident due to the fact that the invention's main frame is a two separate parts, joined in the front of the device by a single male/female insert system that pulls apart horizontally with the simple removal of the front axle and nut; and b. this split two-part frame allows for an emergency release system that allows the whole support system to flex vertically upward and downward to create mobility and comfort for the user.

14. The helmet stabilization device in accordance with claim 10 further comprising:

a. padding materials with and patterns specifically designed to reduce impacts by the dispersion of energy because when in contact with two solid surfaces, the cutout pattern of the material (and the material properties themselves) drastically reduce harsh impacts by dispersing the load in a forty-five degree angle direction from the load being applied which further reduces the likelihood of injury sustained to a user's body during an accident.

15. The helmet stabilization device in accordance with claim 10, further comprising:

a. the top of the main frame curvature of the invention acts as stopping points for a users full face helmet, so that the helmet can stop rotation before it reaches the body, which reduces the likelihood of injury;

b. the stopping points of the helmet are designed to prevent the following extreme movements: hyper flexion (head forward), hyper extension (head backwards), lateral hyper flexion (head sideways), posterior hyper translation (head/helmet reward on the neck), axial loading (spinal column compression); and c. the two-part design also allows the whole support system to flex vertically upward and downward to create mobility and comfort for the user.

16. The helmet stabilization device with in accordance with claim 10, further comprising:

a. padding materials and patterns specifically designed to reduce impacts by the dispersion of energy so that when in contact with two solid surfaces, the cutout pattern of the material (and the material properties themselves) drastically reduce harsh impacts by dispersing the load in a forty-five degree angle direction from the load being applied so that this further reduces the likelihood of injury sustained to a user's body during an accident.

17. The helmet stabilization device in accordance with claim 10, further comprising:

a. a user holds the device by the left and right main frame and places it over the user's head, lowering the support system down until contact is made between the shoulders and shoulder supports, the chest and chest supports, and the back and back supports;

b. once in place, the chest supports will rest on the user's chest around the sternum, and the back supports will rest on the user's back, to the left and right of the spine; and c. to adjust the height of the support system which is the distance between the main frame and the user's shoulders, the user opts to use an additional layer of padding because height adjustment is necessary depending on the user's neck length and mobility while using the support system.

18. The helmet stabilization device in accordance with claim 10, further comprising:

a. once in place on the user's body and a full face helmet is used in conjunction with the support system, activity and/or sport may take place; and b. during an accident, the support system will provide alternative stopping points for the full face helmet, limiting movement, and lowering the potential risk of a cervical spine injury.

19. The helmet stabilization system in accordance with claim 10, further comprising:

a. to use the emergency release system and disassemble the support system, the user removes the front axle nut and then pulls the two main left and right frame components apart horizontally off the user.

* * * * *